United States Patent [19]

Mieyal et al.

[11] Patent Number: 4,546,584

[45] Date of Patent: Oct. 15, 1985

[54] WALL PANEL SYSTEM PROVIDING RESILIENT JOINTS

[75] Inventors: David F. Mieyal, Strongsville; Peter Reynard, Brunswick, both of Ohio

[73] Assignee: Donn Incorporated, Westlake, Ohio

[21] Appl. No.: 512,242

[22] Filed: Jul. 11, 1983

[51] Int. Cl.[4] ..... E04B 2/56

[52] U.S. Cl. ..... 52/281; 52/222; 52/481

[58] Field of Search ..... 52/281, 222, 481, 483, 52/769, 489, 36

[56] References Cited

U.S. PATENT DOCUMENTS

| | | | |
|---|---|---|---|
| 2,896,271 | 7/1959 | Kloote et al. | 52/309.9 |
| 3,313,073 | 4/1967 | Mathews | 52/309.2 |
| 3,327,444 | 6/1967 | Downing, Jr. | 52/476 |
| 3,372,520 | 3/1968 | Hensel | 52/483 |
| 3,513,613 | 5/1970 | Jones et al. | 52/222 |
| 3,685,234 | 8/1972 | Nelsson | 52/36 |
| 3,708,935 | 1/1973 | Kossuth et al. | 52/416 |
| 3,729,883 | 5/1973 | Thompson | 52/481 |
| 3,816,199 | 6/1974 | Dawdy et al. | 52/222 |
| 3,862,530 | 1/1975 | Martine | 52/281 |
| 3,900,996 | 8/1975 | Yohe | 52/241 |
| 3,922,764 | 12/1975 | Downing, Jr. | 24/259 |
| 4,114,333 | 9/1978 | Jones et al. | 52/265 |
| 4,120,124 | 10/1978 | Temple et al. | 52/36 |

*Primary Examiner*—J. Karl Bell

*Attorney, Agent, or Firm*—Pearne, Gordon, Sessions, McCoy, Granger & Tilberry

[57] ABSTRACT

A panel system for walls, ceilings, and the like is disclosed in which the panels are provided with a flexible surface material which extends into resilient means that operate to press the surface material of adjacent panels into face-to-face contact to provide a closed, neat joint between adjacent panels. Because of the resiliency along the joints, brackets, screws, and the like may be inserted through the joints and secured to the panel supporting frame structure without damage to the panel materials. Subsequently, if the brackets, screws, and the like are removed, the resilient means returns the flexible sheet material into the face-to-face abutting condition, re-establishing the closed joint and concealing the fact that anything had previously been inserted through the joint. In some embodiments, the surface sheet material is provided with a loose flap which is inserted into the resilient means after the panels are installed. Shelf standards and the like may be provided behind the joint which are obscured from view, but which permit easy mounting of shelf brackets or the like through the joint.

14 Claims, 13 Drawing Figures

WALL PANEL SYSTEM PROVIDING RESILIENT JOINTS

BACKGROUND OF THE INVENTION

This invention relates generally to panel systems for walls, ceilings, and the like, and more particularly to a novel and improved panel system in which resilient joints are provided between adjacent panels. Such panels permit easy installation with a variety of mounting systems. Further, it permits easy mounting of shelf brackets or the like through the joints between adjacent panels without damage to the panel edges. Additionally, such brackets or the like can be subsequently removed and the resilient edges return the joint to its initial condition, completely hiding the fact that the bracket had once been mounted at the joint.

PRIOR ART

Prefinished wall panels are well known. For example, it is known to laminate a surface sheet of fabric or vinyl sheet material gypsum board or other backing board and to then install the panels on framing such as studs or furring strips to provide a finished attractive wall without requiring papering or painting. In such walls a neat joint is provided between adjacent panels.

In some instances, such panels are kerfed along their edges and are secured to the framing by splines provided by the framing structure which extend into the kerfs to secure the panels into position. Examples of such systems are illustrated in U.S. Pat. Nos. 3,327,444; 3,513,613; 3,729,883; 3,900,996; and 3,922,764.

It is also known to provide sealing gaskets or the like between adjacent panels used to form refrigerated enclosures. Examples of such panel systems are illustrated in U.S. Pat. Nos. 2,896,271; 3,313,073; 3,372,520 and 4,114,333.

It is also known to provide predecorated wall boards having decorative sheet material laminated to the face thereof in which the edges of the sheet material are initially loose to allow finishing of the joint between adjacent panels before the loose flaps of the decorative material are secured in position as illustrated in U.S. Pat. No. 3,708,935.

It is also known, as disclosed in U.S. Pat. Nos. 3,327,444; 3,513,613, supra, to provide loose edges on such decorative sheet material which are tucked into the joint between adjacent panels to provide a closed joint.

It is also known to mount shelf standards along the joints between adjacent panels as illustrated in U.S. Pat. No. 3,685,234.

SUMMARY OF THE INVENTION

There are a number of aspects to the present invention. In accordance with one important aspect of this invention, a panel system is provided in which a facing material extends into the joint between adjacent panels and in which resilient means are provided to bias the facing into engagement along such joints. Because the facing is resiliently biased toward the associated facing of an adjacent panel, it is possible to insert fasteners or brackets to the joint for the mounting of shelving or other devices on the wall. Such mounting of brackets or the like does not damage the edge material of the wall panels along the joint, so if it is desired at some later time to remove the brackets or fasteners the wall reheals itself, obliterating the fact that a bracket or fastener had been located in the joint at one time.

In accordance with another aspect of this invention, a decorative facing material is laminated to the face of the panel while leaving a loose flap along the edges, which can be pulled back to expose the underlying panel material adjacent to its edges. This allows the panels to be mounted in a variety of ways on the supporting framing structure. After the panels are mounted, the flaps are pushed through the resilient edges to provide a neat joint appearance. Here again, if desired, brackets or other devices may be mounted along the joints between adjacent panels and subsequently removed if desired.

In some embodiments providing the loose flap structure, the flaps can be subsequently pulled out to provide access to the mounting structure to allow removal of the panels without damaging the panels so as to permit their reuse.

With the present invention, considerable flexibility is available in the manner in which the panels are installed and an improved finished product is provided which permits easy installation in a removal of brackets or the like along the joints in an assembled wall system.

In the illustrated embodiments, the panels are wall panels, but this invention is also applicable to ceilings and the like, and when the terms "walls" or "wall panels" are used herein, it is intended that such terms encompass ceiling and the like.

These and other aspects of this invention are illustrated in the accompanying drawings, and are more fully described in the following specification.

DETAILED DESCRIPTION OF THE DRAWINGS

Figure 1:
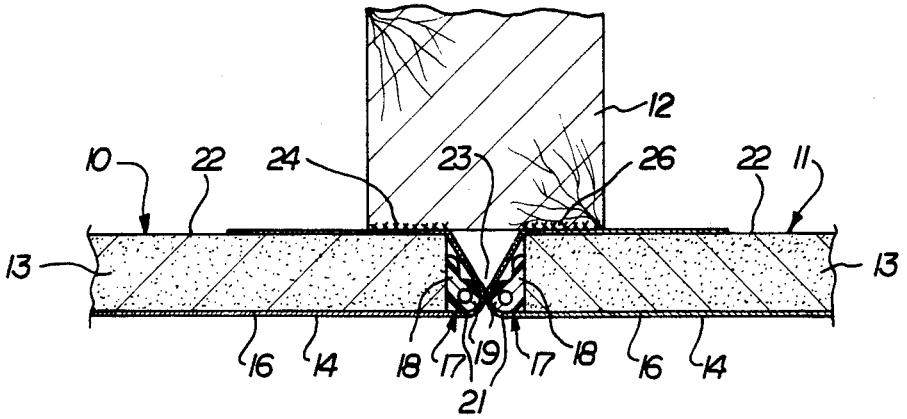
FIG. 1 is a fragmentary cross-section of a first embodiment of this invention in which a decorative facing material is laminated to the face of the panels, extends around a resilient member secured to the edge of the panels, and is secured along the back side of the panels to provide a resilient joint between adjacent panels.

FIG. 1 illustrates a first embodiment of this invention, in which similar panels 10 and 11 are secured by adhesive to a stud or furring strip 12. Each panel includes a gypsum board 13 having a decorative sheet 14 laminated to the front or outer face 16. Bonded to the adjacent edges of each of the panels 10 and 11 is a resilient element 17 providing a base section 18 and a tubular portion 19. The tubular portion 19 is formed with a surface 21 which is an extension of the outer face 16, and extends to a curved section which extends around the tubular portion 19. The decorative sheet material extends around the tubular portion 19 to the rearward face 22, and is laminated to such rearward face for a short distance back from the edges of the panels.

The resilient elements 17 are preferably formed of a relatively soft material which has a very good elastic memory so that it can be deformed from the illustrated shape, as discussed below, when a fastener or bracket is inserted into the joint 23, and so that it will return to its initial position if such bracket or fastener is removed from the joint. Further, the resilient element should be locally deformable so that if a bracket or screw is installed in the joint, the joint will open up only at the particular location where the inserted item is installed and not open up to any material extent on either side of the inserted item. In the structures in U.S. Pat. Nos. 3,327,444 and 3,513,613, the resilient edges which grip the facing are not locally deformable. Such resilient elements, for example, may be formed of a soft neoprene or a PVC foam material, although other suitable materials may be utilized.

The decorative sheet material is usually formed of a fabric or a sheet material, such as vinyl sheet material, which is flexible so that when a fastener is inserted into the joint 23 deforming the resilient elements from the position illustrated in FIG. 1, the fabric is easily deformed with the element and is not damaged by such deformation.

One method of installing the panels 10 and 11 is illustrated in FIG. 1, in which the panels are positioned in abutting relationship and are adhesively bonded along their edges at 24 and 26, respectively, to a stud or furring strip 12, which may be wood or any other suitable material including metal. The panels are positioned so that the portion of the sheet material 14 passing between the two resilient elements 17 are resiliently maintained in abutting contact at the joint 23 by the resilient elements 17. Therefore, a neat, closed joint is provided between the two panels 10 and 11 when they are installed. It should be understood that normally the flexible sheets 14 are selected to provide a predecorated panel, but the present invention is not limited to the use of prefinished sheet material and, in accordance with the broader aspects of this invention, could include the use of a surface sheet material which is subsequently painted or otherwise finished. Also, it should also be understood that, although gypsum board panels are illustrated and described in connection with the illustrated embodiments, other panel materials may be utilized in accordance with the present invention.

Figure 2:
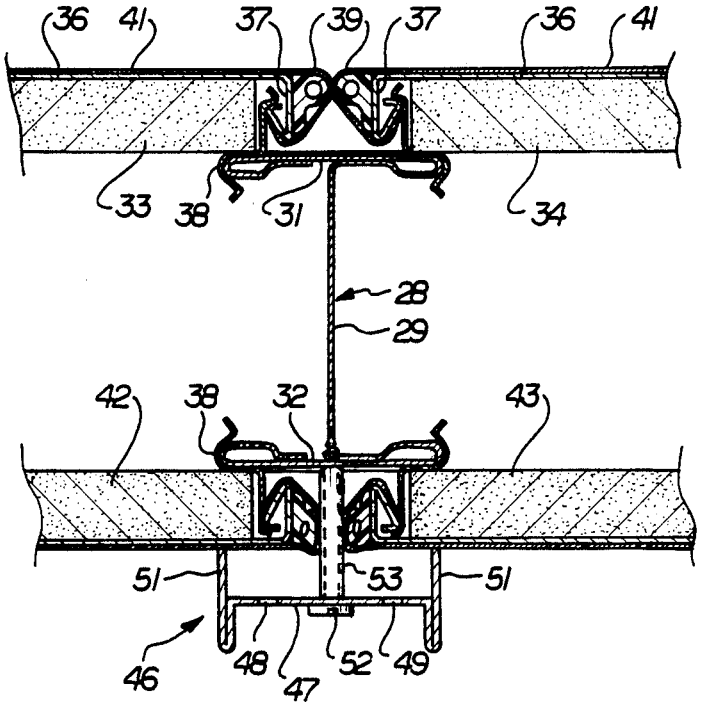
FIG. 2 is a fragmentary cross-section of another embodiment structured for mounting against a metal stud and illustrating an adapter bracket for shelving installed along the joint between the panels and secured to the backing stud.

FIG. 2 illustrates a modified form of panel in which the panels are particularly adapted to be mounted on a metal stud 28. Such stud 28 is formed in a generally I-shaped configuration, and provides a central web 29 and opposed, laterally extending flanges 31 and 32. In this instance, the panels 33 and 34 are again formed of gypsum board, but are formed with a sheet metal surface 36 along the outer surface thereof. The sheet metal facing material is formed with a lock system along its edges formed with a generally J-shaped section at 37. Such lock interengages a mounting clip 38 shaped to lock with adjacent J-shaped sections and with the flanges 31 and 32 of the stud 28. Here again, resilient elements 39 having a shape similar to the resilient elements 17 of the embodiment of FIG. 1 are adhesively bonded along the edges of the panels to resiliently bias an outer sheet material 41 into abutting face-to-face contact when the panels are assembled.

In this instance, the outer sheet material 41 is bonded to the forward or outer side of the sheet metal 36 and extends around the resilient elements 39 and is secured at its edges to the J-shaped locking sections 37. The various elements are proportioned so that when the two panels 33 and 34 are mounted, as illustrated, on the stud 28, the resilient elements close the joint, causing a like face-to-face contact between the associated facing sheets 41.

In the upper part of FIG. 2 as illustrated, the panels are mounted on the stud without any brackets or the like extending through the joint and a simple neat, closed joint is provided. The lower portion as viewed in FIG. 2, however, illustrates one manner in which a bracket can be easily mounted along the joint between the adjacent panels 42 and 43, which are similar to the panels 33 and 34. The particular bracket 46 illustrated is a typical double-width shelf standard which extends along the joint and provides means for securing shelf brackets to the wall. The shelf standard 46 is provided with a central portion or web 47 providing two laterally spaced rows 48 and 49 of longitudinally spaced openings through which two conventional shelf brackets or the like mount. Also provided are legs 51 which space the central web from the wall panels when installed.

Installation of the shelf standard 46 is easily accomplished by a sheet metal screw 52 which extends into the joint and is threaded into the metal stud 29. Preferably, a tubular sheath 53 proportioned to receive the screw 52 is positioned around the screw and is pressed in between the resilient elements 39 to laterally deform such elements and displace the facing material 41 to allow entry of the screw 52. Such sheath is smooth and is preferably rounded at its forward end so as to prevent damage to the surface material and the resilient elements 39 by protecting them from the threads of the screw 52. Installation of the shelf standard is accomplished by inserting the sheaths which protect the forward end of the screw into the joint and then driving the screws 52 into the stud to secure the shelf standard 46 in position. For such purpose, it is preferable to use sheet metal screws which are self-drilling to avoid separate drilling operations.

If at a later time it is desired to remove the shelf standard, the screws 52 are merely backed off until they clear the stud 28 and then the sheaths and screws are pulled back out through the joint with the shelf standard. At such time, the resilient elements 39, due to their elastic memory, return to their initial condition so that the joint is rehealed and returns to the appearance illustrated in the upper portion of FIG. 2.

Preferably, the sheath is formed of a smooth plastic material initially having a closed inner end so that even the point of the screw is enclosed while the sheath is inserted into the joint. Such plastic tube, however, is easily ruptured at its inner end by driving the screw into the installed position. Such sheath virtually ensures that the facing material 41 is not damaged during the driving of the screw into the stud behind the panels.

Figure 3:
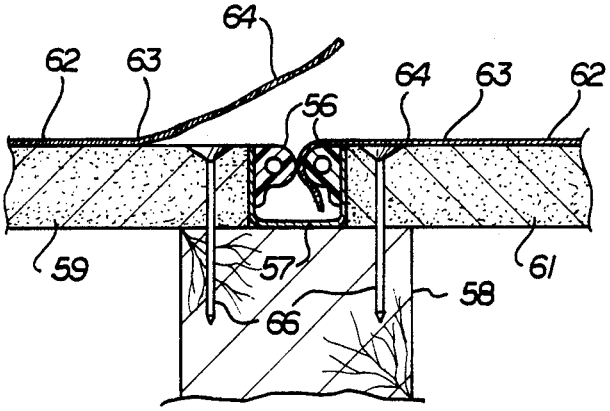
FIG. 3 illustrates another embodiment of this invention in which the decorative facing material is laminated to the panels except along the edges to provide a loose flap so that the panels can be secured to a framing member and after panel installation the flaps are tucked into the joint between two resilient members to provide a finished joint appearance.

FIG. 3 illustrates another embodiment of this invention. In this embodiment, the resilient elements 56 are secured to a U-shaped mounting clip 57, which is in turn secured to a stud or furring strip 58 in any suitable manner, for example, by fasteners or by adhesive. Here again, panels 59 and 61 are formed of gypsum board or other suitable material, and are provided with facing sheet material 62 laminated to the outer face thereof. However, in this embodiment, the facing material is permanently bonded to the outer surface of the panels 59 and 61 only to about the point 63 spaced a small distance back from the edges of the panels to leave a loose flap 64 along each edge of each panel. The flap 64 of the panel 59 is illustrated as loose, and the flap 64 of the panel 61 is illustrated after it has been tucked between the two resilient elements 56.

In this embodiment, the edges of the panels 59 and 61 can be secured directly to the stud or furring strip 58 by any suitable fastener, such as nails or screws 66. Such fasteners can be driven through the panel into the stud, while the flap 64 is bent back to provide access to the panel material itself. The panel edges are spaced from each other by the clip 57 which carries the resilient elements, and which is suitably secured to the stud between the panel edges.

After the panels are connected, the edges provided by the loose flaps 64 are pushed back into the joint between the two resilient elements 56 to provide the finished, closed joint. Preferably, the two resilient elements 56 mounted in the clip 57 are sized so that they lightly engage prior to the insertion of the surface sheet material 62 so that when the loose ends provided by the flaps 64 are pressed between the resilient elements, they are resiliently biased into face-to-face contact and sufficient friction is developed to maintain the exposed portions of the flap smooth and relatively snug against the panels.

With this embodiment, the edges of the flaps can be tucked into position with a simple roller tool which is rolled along the joint to first insert one flap and then the other. Such tool, for example, may resemble a roller cutter often used for cutting pizza or the like, but should have a dull edge so that it does not damage the sheet material as it is pushed into the joint. Here again, brackets or shelf standards can be installed by inserting fasteners through the joint, laterally displacing the adjacent sheet material and resilient elements in the plane of the panels without damage to either the facing material or the resilient elements. If after installation it is desired to remove such screws or brackets, they are merely removed from the joint and the resilient elements return the joint to its initial neat appearance.

This embodiment of this invention has an additional advantage, since if it is decided to remove one or more panels from the wall or ceiling structure, the flaps are merely pulled out from between the resilient elements 56 providing access to the fasteners 66, which can be then removed without damaging the surface sheet material and without significant damage to the panels. Such panels can then be reinstalled and, after reinstallation, the loose flaps are again pushed into the joint to provide a finished appearance. Such feature is particularly desirable where walls must be moved or panels must be removed to provide access to the interior of the wall. Because the removal of the panels does not damage them in any significant manner, they can be reused as often as desired.

Figure 3A:
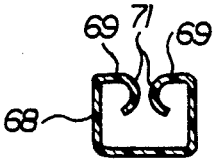
FIG. 3*a* illustrates a modified type of resilient clip which may be used in the embodiment illustrated in FIG. 3.

FIG. 3*a* illustrates a modified form of clip in which the clip 68 is formed of a resilient extruded material having inturned edges 69 which extend into curved resilient portions 71 which are opposed to each other. Such clip is preferably extruded from a resilient elastomeric or plastic material so that the integral inwardly projecting portions 69 and 71 provide the localized resiliency to allow the insertion of the flaps into the joint and for the insertion and removal of separate fasteners into the joint when desired. In FIG. 3*a*, the curved resilient portions are shown as spaced for purposes of illustration, but in practice are close enough to resiliently press the sheet material together when it is inserted therebetween. The clip of FIG. 3*a* is generally U-shaped in the same manner as the clip 57 of FIG. 3, and eliminates the requirement for separate resilient elements 56 as illustrated in FIG. 3. Here again, the material used for the clip 68 and its cross section is selected to permit localized resilient deformation when an item is installed through the joint and so that sufficient elastic memory is provided to reclose the joint when such item is removed.

Figure 4:
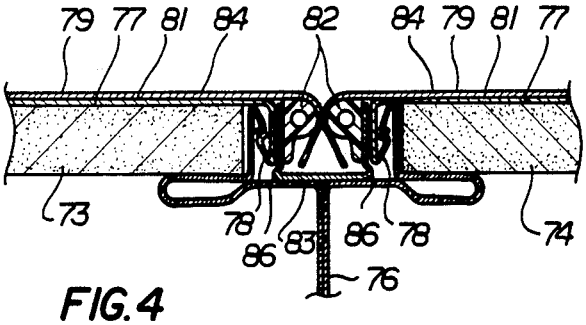
FIG. 4 illustrates another mounting system utilizing the loose flap concept in which the resilient elements are carried by a separate clip which is inserted into the joint and in which the flaps are thereafter tucked in between resilient elements.

FIG. 4 illustrates still another embodiment of this invention. In this embodiment, the panels 73 and 74 are again mounted on a sheet metal stud 76 with a locking system similar to the locking system illustrated in FIG. 2. Here again, the panels are provided with a facing of sheet metal 77 provided with a J-shaped locking section 78 at their edges. In this instance, however, the stud itself is provided with the remaining locking section which engages the J-shaped locks on the panels and secures the panels against the stud 76. Here again, the flexible facing material 79 is laminated to the outer face of the sheet metal 77 to a point at about 81 to leave a loose flap. In this embodiment, the resilient elements 82 are again carried in a U-shaped clip 83.

Installation of the panels in accordance with this embodiment is as follows. First, the panels 73 and 74 are snapped onto the stud 76 to interlock the panels to the stud. Then while the flaps 84 are folded back, the clip 83 is pressed into the joint between the panels. The clip 83 in this instance is provided with a slight lateral extension at 86 which serves to lock the clip in its installed position once it is pressed between the panels. The flaps 84 are then tucked into the joint between the resilient elements to give a finished closed joint. Because of the resiliency of the joint provided by the resilient elements 82, suitable fasteners can be inserted into the joint and secured to the stud without damage to the panel edges and, upon their removal, the joint is rehealed to its initial condition.

Figure 4A:
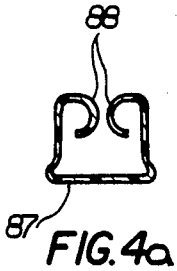
FIG. 4*a* illustrates a modified form of clip that can be used in the embodiment of FIG. 4.

FIG. 4*a* illustrates a modified form of clip 87 which can be substituted for the clip 83. Here again, the clip 87 is formed with integral, inwardly projecting, resilient portions 88 which eliminate the necessity of separate resilient elements (shown spaced apart for purposes of illustration), and which are deformable to allow the insertion of the loose flaps and to allow the installation and removal of brackets to the joint.

Figure 5:
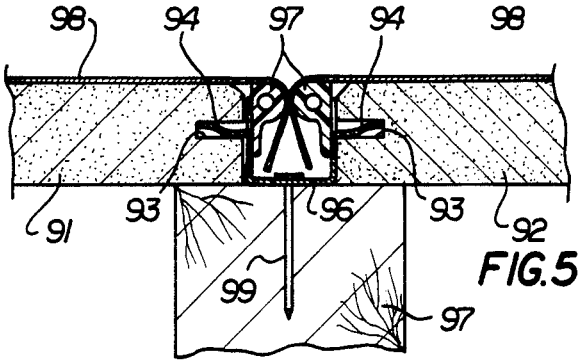
FIG. 5 illustrates still another embodiment utilizing a kerf and spline mounting system combined with the loose flap system.
Figure 6:
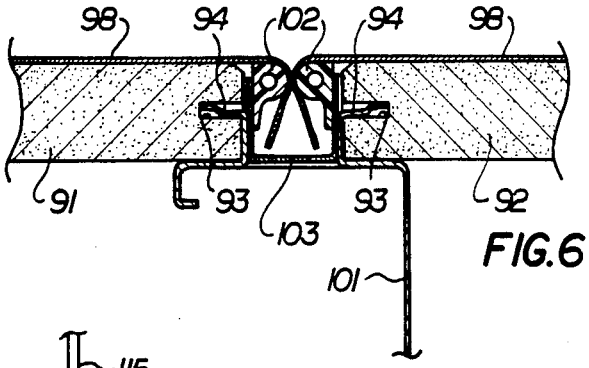
FIG. 6 is still another embodiment of a mounting system incorporating the loose flap system.

FIGS. 5 and 6 illustrate additional embodiments in which the panels 91 and 92 are formed with kerfs 93 along their edges proportioned to receive splines 94 to lock the panels in place. In the embodiment of FIG. 5, a U-shaped mounting clip 96 is secured to a stud 97 and is provided with the splines 94 which fit into the kerfs 93 of the panels. Here again, the clip is provided with resilient elements 97 between which the loose flaps of the facing sheets 98 are pressed after the panels are installed. In the embodiment of FIG. 5, the clip is secured to the stud in any suitable means, such as by a fastener 99.

In the embodiment of FIG. 6, a metal stud 101 is provided with the splines 94 and the resilient elements 102 are carried by a separate clip 103 mounted on the stud 101. Here again, the loose flaps of the facing sheets 98 are pressed between the resilient elements 102 after the panels are installed.

Figure 7:
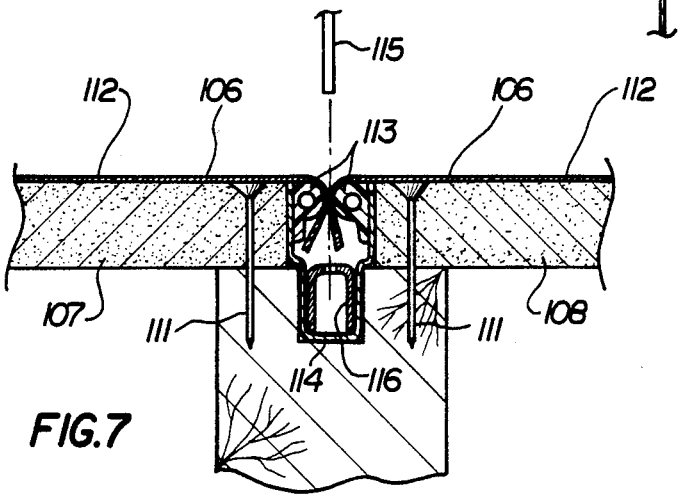
FIG. 7 illustrates still another embodiment in which a bracket standard is mounted behind the joint so that brackets, such as brackets for shelving, may be inserted through the joint and connected to such standard and wherein the standard itself is completely obscured from view.

FIG. 7 illustrates another embodiment of this invention which is used with panels provided with loose flaps 106 along the edges of the panels. In this embodiment, the panels 107 and 108 are again secured to a stud 109 by fasteners 111. The loose flaps 106 of the facing sheets 112 are folded back while the fasteners 111 are installed. In this embodiment, the resilient elements 113 are mounted on a channel-shaped clip 114 which extends into a groove formed in the stud 109 to receive a shelf standard 116 of typical design. This shelf standard is again provided with longitudinally spaced grooves which receive and lock with shelf brackets 115 or the like. In this instance, the panels are secured to the stud on opposite sides of the mounting clip 114 and the loose flaps are pressed between the resilient members in the usual way.

The shelf standard 116 is completely obscured from view in this embodiment. When it is desired to install shelving or any other bracket 115 along the joint between two adjacent panels, the bracket 115 is inserted between the facing sheets 112, laterally displacing them from their normal position, and the bracket is hooked into the standard 116. When it is desired to remove the bracket, it is merely disconnected from the standard in the usual way and removed. Once this occurs, the standard again is obscured and the joint returns to its initial closed condition.

Figure 7A:
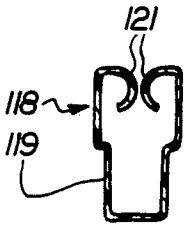
FIG. 7*a* illustrates a modified clip which may be used in the system of FIG. 7.

FIG. 7*a* illustrates a modified form of clip 118 which may be substituted for the clip 114. This clip provides a lower section 119 proportioned to receive the shelf standard and integral, inturned resilient portions 121, which replace the separate resilient elements 113.

Figure 8:
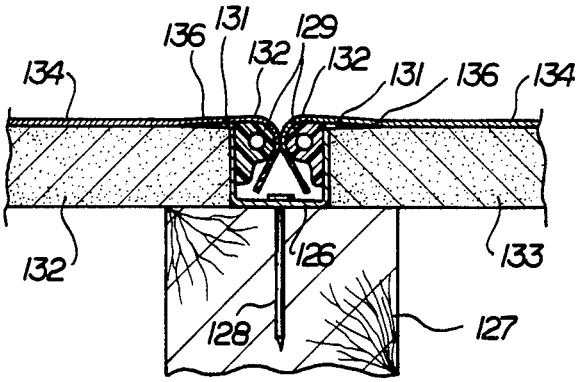
FIG. 8 illustrates another embodiment in which the clip which supports the resilient members also provides a structure which extends along the outer face of the panels to secure the panels in position.

FIG. 8 illustrates still another embodiment. In this embodiment, a mounting clip 126 is secured to a stud 127 by a fastener 128. Such clip is generally U-shaped, and supports resilient elements 129 in the usual manner. The clip 126, however, is provided with tapered opposed extensions 131 which project along the outer face of the panels 132 and 133 to secure the panels in contact with the stud 127. Here again, the panels 132 and 133 are provided with a facing sheet 134 which is laminated to the outer panel surfaces except along the edges of the panels to provide a loose flap 136 which is pushed between the two resilient elements 129 after the panels are secured in position.

In this embodiment, the panels can be installed in two ways. In accordance with the first method of installation, the panels 132 and 133 are properly positioned against the stud. The clip 126 is then inserted between the panels while the loose flaps 136 are folded back and the clip is then secured to the stud 127. As an alternative, the clip 126 can be mounted on a first stud and a panel inserted laterally into its installed position beneath the associated tapered extension 131, while the loose flap 136 is folded back clear of the joint. A clip 126 is then installed along the opposite edge of the panel and secured to the stud, and a subsequent panel is positioned adjacent to such opposite edge. With such progressive installation of panels and clips, the tight fitting of the clips against the panel edges is ensured because the position of each subsequent clip is determined by the location of the associated edge of the previously installed panel. Here again, the loose flaps 136 are subsequently tucked or pushed between the two resilient elements 129 to provide a closed panel joint through which fasteners for securing brackets or the like may be inserted and removed.

Figure 8A:
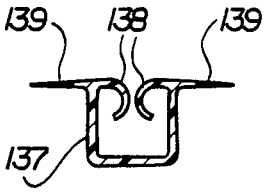
FIG. 8*a* illustrates a modified clip for use in the system of FIG. 8.

FIG. 8*a* illustrates a one-piece modified clip 137 which can be used in the system of FIG. 8. Such clip is again U-shaped, providing inturned, resilient portions 138 and oppositely extending, tapered panel retaining extensions 139.

In each of the embodiments providing loose flaps along opposite panel edges, the loose flaps may be provided with a strippable adhesive which lightly adheres the loose flaps to the panel edges during shipping and handling so as to prevent the loose flaps from becoming creased or otherwise damaged. At the time of installation, this strippable adhesive allows the flaps to be pulled back for the installation process, and the flaps can then be pressed into the joint to provide the closed joint appearance. This light adhesive also tends to ensure that once the flaps are tucked into the joint, they remain smooth because the light or strippable adhesive along the underside of the flaps tends to cause some degree of adherence with the adjacent panel surfaces and the resilient elements.

Figure 9:
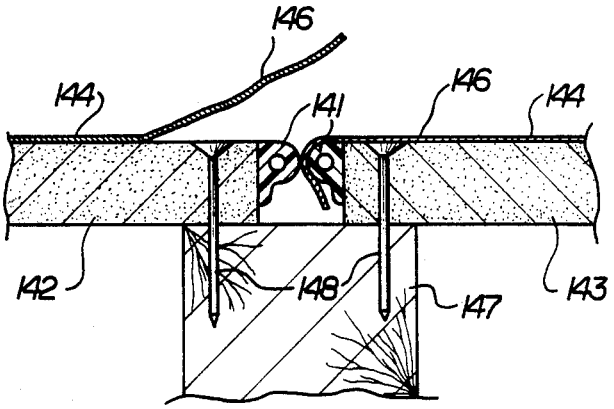
FIG. 9 is another embodiment in which the panels provide loose flaps and resilient members secured along their edges.

FIG. 9 is an embodiment similar to the embodiment of FIG. 3, except that the resilient elements 141 are mounted directly on the adjacent panels 142 and 143 rather than on a separate clip, as in the embodiment of FIG. 3. Here again, the panels are provided with a facing sheet 144 providing loose flaps 146 which can be pulled back during the mounting of the panels on a stud 147 so as to expose the underlying portion of the panel adjacent to the edges thereof during the mounting of the panels on the stud.

While the underlying portion of the panel is exposed, fasteners, such as screws or nails 148, are driven into place to securely mount the panels to the underlying stud. Thereafter, the loose flaps are pushed between the two resilient elements 141 to cover the fasteners and provide the finished joint appearance. In instances in which it is likely that the panels may have to be removed at a subsequent time, it is preferable to use screws to mount the panels on the stud 147. Removal of the panels can then easily be accomplished by pulling the loose flaps out, exposing the screws, which can be removed without causing any significant damage to the panel itself. In this way, panels can be removed and reused as often as necessary.

In each of the various embodiments illustrated, it is possible to insert separate elements, such as screws, brackets, or the like, through the joints between the panels without damaging the panels in any way. Further, when the various items are removed from between the panels, the resilient elements or means automatically returns the panel joint to its initial closed condition. In addition, with the illustrated embodiments considerable flexibility is available for the mounting of the panels and/or their removal. This is particularly true in the case of the embodiments providing the loose flap on the facing material. Normally, the facing material will be selected to provide a prefinished panel system, eliminating the need for painting, papering, or the like.

Although the preferred embodiments of this invention have been shown and described, it should be understood that various modifications and rearrangements of the parts may be resorted to without departing from the scope of the invention as disclosed and claimed herein.

What is claimed is:

1. A surface structure for rooms and the like, comprising support framing, a plurality of panels mounted on said support framing in edgewise alignment to provide closed joints therebetween, and resilient means positioned along said joint, said panels providing a flexible surface material extending along the exposed surface thereof and into said resilient means, said resilient means biasing said flexible surface material of adjacent panels into surface-to-surface contact to provide said closed joint between said panels, said resilient means permitting localized lateral separation of said flexible surface material along said joints when a separate member is inserted through said joint and causes said flexible material to establish said surface-to-surface contact when a separate member is removed from said joints, tubular sheath means being provided to separate said flexible surface material along said joint, said sheath means being adapted to permit insertion of a fastener through said joint into said support framing without damaging said flexible surface material.

2. A surface structure as set forth in claim 1, wherein said sheath provides a closed inner end which can be ruptured by said fastener.

3. A surface structure for building structures comprising support framing, a plurality of panels, connecting means securing the edges of said panels to said support framing in edgewise alignment to provide joints between adjacent edges of adjacent panels, said support framing providing a frame member behind said joints and extending lengthwise thereof, a mounting standard positioned along at least one of said joints on the side of said panels remote from the associated of said frame members, and fasteners installed after said panels are secured to said support framing extending through said one joint securing said standard the said associated frame member without causing damage to said adjacent edges of said adjacent panels, said standard providing attachment means permitting attachment of accessories to said standard for support by said framing structure, said fasteners being removable to demount said standard, said one joint between said adjacent edges of said adjacent panels being returned substantially to its original condition after removal of said fasteners and standard.

4. A surface structure as set forth in claim 3 wherein said standard provides a projection extending into said one joint between said adjacent edges of said adjacent panels, said fastener extending through said projection, said projection projecting the associated adjacent edges of said adjacent panels from damage when said fasteners are installed through said joint and removed from said joint.

5. A surface structure as set forth in claim 4 wherein said panels provide resilient edge means which normally abut to close said joints, said projection operating to resiliently deflect said resilient joint means to open the joint between said panels and allow installation and removal of said fastener without damage to said edges of said panels.

6. A panel system for room surfaces comprising a plurality of planar panels having face and back sides and opposite panel edges, said panels being adapted to be connected to a support frame in a mounted position with adjacent of said edges abutting and said back sides of said panels adjacent to said edges secured to said support frame, said panels providing lock means spaced from and substantially adjacent to said panel edges accessible from said back sides and isolated from said front sides, said lock means being releasably connectible with said support frame to secure said panels in said mounted position without disturbing said face sides, said panels providing resilient means along said panel edges, flexible sheet material along said face sides extending around said resilient means and secured to said back sides at a location clear of said lock means, said resilient means maintaining said sheet material of adjacent panels in contact along said panel edges when said panels are in said mounted position to close the joint therebetween, said resilient means permitting localized lateral displacement of said flexible material when a separate member is inserted through said closed joint and operating to return said flexible material into engagement upon removal of said separate member.

7. A panel system as set forth in claim 6, wherein said panels provide a metal sheet along said face side beneath said flexible sheet material, said metal sheet being sent back from said face side to form said opposed edges and being inturned along said back side to provide said lock means.

8. A panel system as set forth in claim 7, wherein said metal sheet is formed with a J-lock to provide said lock means, and the edges of said flexible sheet are secured to said J-lock.

9. A panel system as set forth in claim 7, wherein said resilient means is provided by an extrusion of resilient material secured to said metal sheet along said opposed edges.

10. A panel system as set forth in claim 6, wherein said separate member is a fastener operable to extend through said closed joint and secure a bracket against said face side by connecting directly to said support frame.

11. A panel system as set forth in claim 10, wherein said fastener is a threaded fastener and a smooth sheet encloses said fastener to prevent the threads thereon from damaging said flexible sheet material.

12. A demountable wall system comprising metal studs providing panel-engaging flanges, a plurality of planar panels having face and back sides and opposite panel edges, said panels being connected to and supported by said studs in a mounted position with adjacent of said edges abutting and said back sides of said panels adjacent to said edges secured against said flanges, said panels providing lock means spaced from and substantially adjacent to said panel edges connected to said studs by a connection which is accessible from said back side and isolated from said front side, said lock means releasably connecting said panels to said studs without disturbing said face sides of said panels, said panels providing resilient means along said panel edges, and flexible sheet material along said face side of said panels extending around said resilient means and secured to said back side at a location clear of said lock means, said resilient means being operable to resiliently press said flexible sheet material into engagement with said flexible sheet material of an adjacent panel when said panels are installed to close the joint therebetween, said resilient means permitting localized lateral displacement of said flexible material when a separate member is inserted through said closed joint.

13. A demountable wall system as set forth in claim 12, wherein a bracket is secured along at least some of said closed joints and against said face side by fasteners extending through said closed joint and secured to said flanges.

14. A demountable wall system as set forth in claim 13, wherein said fasteners are threaded fasteners and a smooth sheath is positioned around said threads to protect said flexible material from said threads when said fastener is installed within said closed joint.

* * * * *